United States Patent [19]

Ambrose

[11] 4,190,158

[45] Feb. 26, 1980

[54] CONTAINER FOR DELICATE ARTICLES

[76] Inventor: Charles J. Ambrose, 2230 Benton St, Richland, Wash. 99352

[21] Appl. No.: 613,402

[22] Filed: Sep. 15, 1975

[51] Int. Cl.[2] ..... B65D 85/30; B65D 81/02

[52] U.S. Cl. ..... 206/522; 53/433

[58] Field of Search ..... 206/522; 53/22 A, 22 B

[56] References Cited

U.S. PATENT DOCUMENTS

| | | | |
|---|---|---|---|
| 1,827,322 | 10/1931 | Lindermann | 206/522 |
| 3,038,593 | 6/1962 | Root et al. | 206/522 |
| 3,138,248 | 6/1964 | Abbott | 206/522 |
| 3,302,780 | 2/1967 | Massman et al. | 206/522 |

FOREIGN PATENT DOCUMENTS

| | | | |
|---|---|---|---|
| 1603215 | 4/1971 | France | 206/522 |
| 848248 | 9/1960 | United Kingdom | 206/522 |

*Primary Examiner*—Joseph Man-Fu Moy

*Attorney, Agent, or Firm*—Robert Keith Sharp

[57] ABSTRACT

A container for delicate articles which includes an inner envelope, and an inflatable outer envelope sealed to the ends thereof. The inner envelope is vented to the exterior of the container so that, on inflation of the outer envelope, the inner envelope is collapsed tightly about the article, which is thus suspended in and protected by the inflated outer envelope. Preferably, the inflation is accomplished within an outer protective casing, which is coated on its interior with an adhesive. Should the casing and outer envelope be punctured, the parts will then still be kept in essentially established positions.

8 Claims, 6 Drawing Figures

CONTAINER FOR DELICATE ARTICLES

BACKGROUND OF THE INVENTION

The packaging of delicate objects for shipment usually involves the use of bulky packaging materials, such as excelsior, shredded or wadded paper, or granulated plastic foams. These cause inconvenience in handling. In other cases, plastic foam is molded or cut to fit closely around the object. This is troublesome and expensive, particularly when various kinds of objects are to be shipped. It is used principally in connection with mass produced items. Moreover, it must often be supplemented by the use of loose packing of the type described above.

Various inflated containers are shown in the patented art. Among these are Butler, U.S. Pat. No. 1,457,496; Root et al, U.S. Pat. No. 3,038,593; and Abbott, U.S. Pat. No. 3,138,248. To the best of my knowledge, none of these are in use today. Some appear to be fundamentally defective, others difficult and expensive to manufacture.

An object of my invention is to provide a package including a flexible, inflatable container which is cheap and effective and which is very compact when empty.

It is also an object of my invention to provide a method of packaging utilizing the container referred to above which will cause the article packaged to be firmly held in position.

It is also an object of my invention to provide a package including the container referred to above which is of such character that the article will be protected even if the container is punctured.

SUMMARY OF THE INVENTION

My package comprises a double envelope. The inner envelope receives the article to be packaged. An outer envelope, which has normal dimensions, i.e., dimensions before inflation, in all directions substantially greater than the inner, is sealed to the latter only adjacent its ends. The inner envelope is left open at one end to receive the article. Preferably its walls are sealed together inwardly of the other end, in order to position the article. The outer envelope is provided with means for inflating it, which may be simply a tube which may be heat sealed or closed by mechanical means. The article is inserted and the outer envelope is inflated while the inner envelope remains open. This stretches the inner envelope and collapses it about the article. Because of the relative dimensions of the two envelopes, the article is suspended in the art, spaced in all directions from the outer envelope. It is important that the inner envelope be vented at the time the outer envelope is inflated, as otherwise the inner envelope will not collapse about the article so as to hold it in position.

Preferably, the inflation takes place within a casing of such a size that the outer envelope is pressed against it, coated on its inside with an adhesive which adheres to the envelope. It is desirable to seal the inner envelope after the inflation step. Then, if the casing and outer envelope should be accidentally punctured, the article will still be held suspended and protected.

In another embodiment I provide for refrigeration of the article, which may be fish or other perishable substance. I provide an intermediate envelope which can be filled with liquid and frozen after being sealed, a mold of the size and shape of the article being placed in the inner envelope if it is not desired to freeze the article itself. The article is then inserted (if it was not present during the freezing) and the inner envelope is partially evacuated and then sealed. The container is then placed in the adhesive-coated casing, which is preferably of an insulating character, and the outer envelope inflated and sealed. As the ice begins to melt, the inner envelope will collapse about the article, holding it tightly in position.

DETAILED DESCRIPTION

Figure 1:
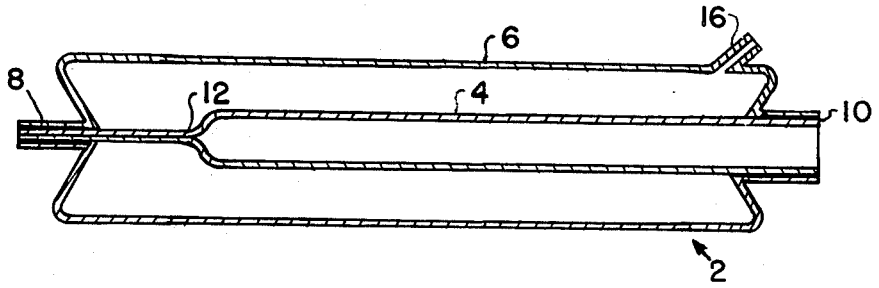
FIG. 1 is a longitudinal section of an empty container embodying my invention.
Figure 2:
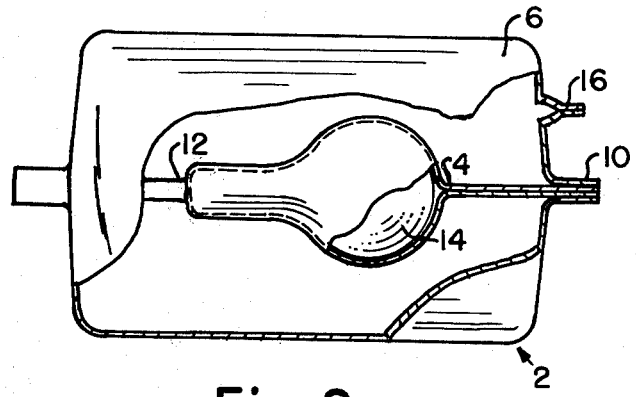
FIG. 2 is a view partially in elevation and partially in longitudinal section of the container of FIG. 1 after loading and inflation, taken on a plane perpendicular to that of FIG. 1.
Figure 3:
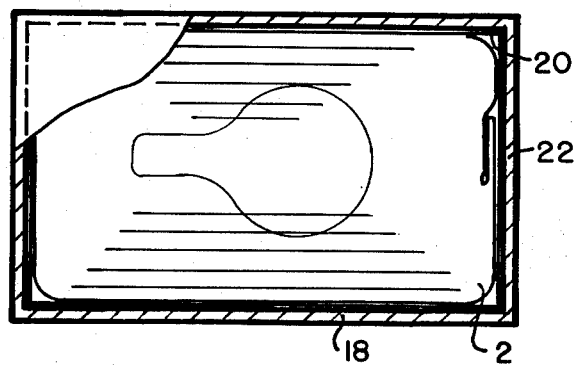
FIG. 3 is a view of the loaded and inflated container of FIGS. 1 and 2 in a casing, partially in elevation and partially in section.

Referring to FIGS. 1, 2 and 3, my invention involves a double envelope, 2, made of flexible sheet material, preferably heat-sealable, such as polyethylene. It includes an inner envelope 4, and an outer envelope 6, which are sealed to each other at both ends, 8 and 10. The inner envelope 4 is left open at least at one end, 10. This is readily accomplished by insertion of a strip of metal, e.g., aluminum foil, in end 10 of envelope 4 during the heat-sealing step. End 8 may also be left open, but normally inner envelope is closed at this end for convenience in loading. Preferably, inner envelope 4 is sealed up to an intermediate point 12 in order to position the article to be packaged. The article 14 can then be simply dropped in open end 10 of inner envelope 4.

Next, outer envelope 6 is inflated. The inflating means can be simply a heat-sealable tube 16 of the same material as the envelopes 4 and 6. The tube may also be closed by mechanical means or may be provided with a valve. After inflation, the tube 16 is heat-sealed, as shown in FIG. 2, or otherwise closed.

It is important that envelope 4 be vented to the atmosphere during the inflation of outer envelope 6. When this is done, inner envelope 4 is collapsed tightly about article 14, as shown, the air within the inner envelope being expelled through the open end. Therefore, end 10 of inner envelope is left open at least until the inflation is completed. I have found that in many cases it is unnecessary to close it at any time. However, it may then be heat-sealed and in some cases this sealing is desirable, as will be explained below.

The normal dimensions of the outer envelope are greater in all directions than those of the inner envelope, so that the inner envelope is stretched and the article is suspended spaced from all walls of the outer envelope.

The container described above is ordinarily enclosed in a box or casing for shipment. A particularly desirable arrangement is shown in FIG. 3.

Casing 18 is first coated on the inside with an adhesive 20 which will adhere tightly to the material of container 2. The latter is first partially inflated, then, with end 22 of casing 18 open, it is carefully positioned in the casing and inflated until it is pressed against adhesive 20. It is desirable to heat-seal end 10 of inner envelope 4 at this time. End 22 is then closed.

Alternatively, the container may be sealed to the casing before inflation. For example, casing 18 may be a cardboard box of the usual type, which is stored in quantities in a collapsed condition with the ends folded out. My container may be packed inside the box, adhesively secured to the sides of the box. When the box is assembled the container will be held in an extended condition. After insertion of the article, the outer envelope is inflated, collapsing the inner envelope about the article. Open end 10 of envelope 4 is then preferably sealed.

With the container in the casing and adhesively joined to it, the package is very secure. Even if the casing and outer envelope should be punctured, the inner envelope will be held suspended and, since it was sealed in its collapsed condition, will continue to hold article 14 securely in position.

It may be desirable, particularly if the articles to be packaged are comparatively heavy, to make inner envelope 4 of fabric-reinforced sheet material.

Figure 4:
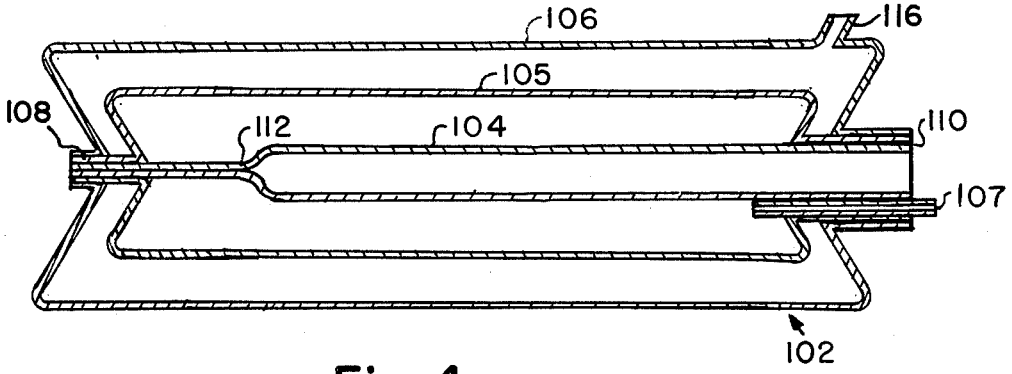
FIG. 4 is a longitudinal section of a modification of my container adapted for refrigerated shipment.
Figure 5:
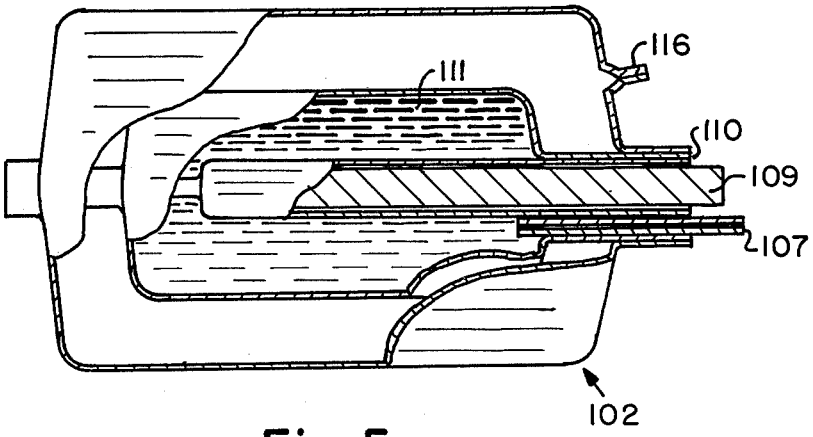
FIG. 5 is a view, partially in elevation and partially in section, of the container of FIG. 4, on a plane perpendicular to that of FIG. 4, at an intermediate stage of its loading.
Figure 6:
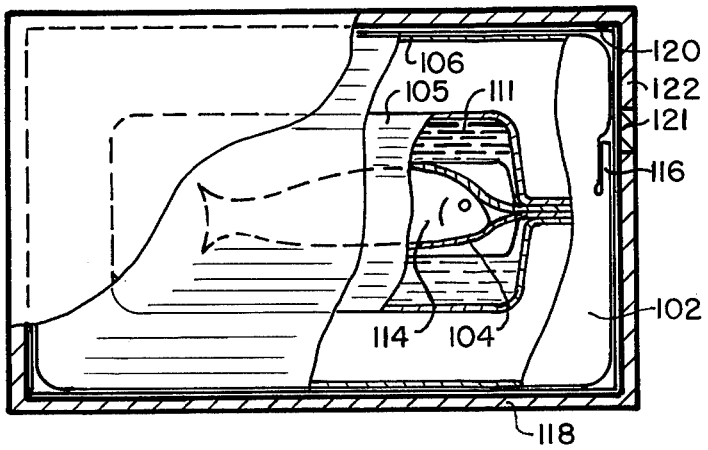
FIG. 6 is a view, partially in elevation and partially in section, of the completed package involving the modification of FIGS. 4 and 5.

In FIGS. 4, 5, and 6, I show a package for the refrigerated shipment of, for instance, a freshly caught salmon. The heart of the package is a container, 102, similar to container 2 of FIGS. 1, 2, and 3. The empty container is shown in FIG. 4. It comprises an inner envelope 104 and an outer envelope 106 corresponding to envelopes 4 and 6 of FIGS. 1 and 2. In addition, it includes an intermediate envelope 105. All three envelopes are sealed together and inner envelope is sealed shut at one end, 108. At the other end, 110, the three envelopes are sealed together, but inner envelope 104 is left open, as was inner envelope 4. A filling tube 107 leading to the interior of intermediate envelope 105 is also provided. It is sealed between the intermediate and inner envelopes but is left open. The inner envelope may be sealed at a point 112 if desired, though this is less necessary in this modification than in that of FIGS. 1–3. Outer envelope 106 is provided with an inflating tube 116.

The next stage in the formation of the package is shown in FIG. 5. A mold 109 of approximately the same size and shape as the article to be packaged is inserted into inner envelope 104. Water or other liquid, 111, is then introduced into intermediate envelope 105 through filling tube 107, which is then sealed. Intermediate envelope 105 should be substantially filled. Container 102, with mold 109 in place, is put in a freezer and water or other liquid 111 is frozen. Mold 109 is then withdrawn and replaced by article 114, e.g., a salmon (FIG. 6). Inner envelope 104 is then evacuated and the end 110 is sealed shut.

Container 102 is then positioned in casing 118 and outer envelope 106 is inflated until it contacts adhesive coating 120. End 122 is then closed and fastened. It is desirable in this embodiment to then deliberately lower and pressure in outer envelope 106 in order to lessen the heat conduction. (If adhesive 120 is of a setting type, sufficient time should be allowed to elapse to insure that container 102 is firmly adhered to casing 118.) For example, tube 116 may be withdrawn through an aperature 121 provided in end 122 and air withdrawn from outer envelope 106. The pressure should, however, be left greater than that in inner envelope 104. As soon as the ice 111 begins to melt, inner envelope 104 will collapse around the fish 114, holding it tightly in position.

If the outer envelope is adhered to the box or casing in advance, as described above, it is unnecessary to inflate it, as atmospheric pressure will cause the collapse of the inner envelope if the latter is evacuated and then sealed.

The container 2, FIGS. 1 and 2, which constitutes the heart of my invention can be made by several different methods. For example, the inner and outer envelopes may be formed from extruded polyethylene tubes. The smaller is given the intermediate seal 12, then inserted inside the larger and they are heat-sealed together and the outer seal shut, a strip of metal, e.g., aluminum foil or other material to which the polyethylene will not adhere, being inserted one end of the inner tube, as described above, thus leaving the inner envelope open at one end.

In a second method each envelope can be formed from a flat sheet which is folded over and sealed at the edges. In this method the inner envelope is first formed, then the outer envelope is folded over and sealed at its edges and to the inner envelope.

Coaxial extrusion can also be used. In this method, a double tube is extruded and cut to suitable lengths. The procedure is then the same as for the first method.

Injection molding can also be employed, the inner and outer envelopes being molded in one piece, closed at what becomes seal 12 (FIG. 1). Outer envelope 6 exists in the form of an enlarged extension from end 10 of inner envelope 4. This extension is then folded back and its open end is heat-sealed across the closed end mentioned above, forming end 8 of the completed container.

I claim as my invention:

1. A container for fragile articles comprising an outer envelope of flexible sheet material, an elongated inner envelope of flexible sheet material for receiving an article, extending across said outer envelope, said outer envelope having normal dimensions in all directions greater than said inner envelope, the walls of said outer envelope being sealed to said inner envelope only adjacent each end of the latter, the interior of said inner envelope being vented to the atmosphere outside said outer envelope, and means for inflating said entire outer envelope, thereby expelling air from said inner envelope and collapsing said inner envelope tightly about said article, said outer envelope being empty except for said inner envelope.

2. A container as defined in claim 1 and further comprising a substantially rigid casing surrounding and in contact with said outer envelope over a substantial portion of the surface of the latter and adhesively joined to said outer envelope.

3. A container for fragile articles comprising an outer envelope of flexible sheet material, an elongated inner envelope of flexible sheet material for receiving an article, extending across said outer envelope, said outer envelope having normal dimensions in all directions greater than said inner envelope, the walls of said outer envelope being sealed to said inner envelope only adjacent each end of the latter, the interior of said inner envelope being vented to the atmosphere outside said outer envelope, an intermediate envelope within said outer envelope and surrounding said inner envelope, said intermediate envelope being sealed to said outer and inner envelopes, means for introducing liquid into said intermediate envelope, and means for inflating said entire outer envelope, thereby expelling air from said inner envelope and collapsing said inner envelope tightly about said article, said outer envelope being empty except for said inner and intermediate envelopes.

4. A container as defined in claim 1 wherein said inner envelope is open at one end to provide a vent to the atmosphere and permit insertion of the article to be packaged and is sealed at a point within said outer envelope spaced from both ends of said inner envelope, to position the article to be packaged.

5. A method of packaging an article comprising:

(a) providing a container comprising an outer envelope of flexible sheet material and an elongated inner envelope of flexible sheet material, within and extending across said outer envelope, said outer envelope having normal dimensions in all directions greater than said inner envelope, said outer envelope being sealed to said inner envelope solely adjacent the ends of the latter, said inner envelope being open at at least one end, said outer envelope being empty except for said inner envelope;

(b) inserting said article into said inner envelope; and (c) inflating said entire outer envelope while said inner envelope is open to the atmosphere, thereby expelling air from said inner envelope and collapsing said inner envelope about said article.

6. A method as defined in claim 5 wherein said outer envelope is adhesively secured to a surrounding substantially rigid protective casing.

7. A method as defined in claim 6 comprising inserting said container in a casing coated on the inside with a contact adhesive prior to inflation and inflating said outer envelope into contact with said casing.

8. A method as defined in claim 6 and further comprising sealing said inner envelope after inflating said outer envelope.

* * * * *

UNITED STATES PATENT AND TRADEMARK OFFICE

CERTIFICATE OF CORRECTION

PATENT NO. : 4,190,158

DATED : Feb. 26, 1980

INVENTOR(S) : Charles J. Ambrose

It is certified that error appears in the above—identified patent and that said Letters Patent is hereby corrected as shown below:

In the specification, column 1, line 51, "art" should read - - air - -.

Signed and Sealed this

*Eighth* Day of *July 1980*

[SEAL]

*Attest:*

SIDNEY A. DIAMOND

*Attesting Officer*

*Commissioner of Patents and Trademarks*